United States Patent [19]

Stafford

[11] 4,272,060

[45] Jun. 9, 1981

[54] FENCE SYSTEM

[76] Inventor: Robert T. Stafford, 5112 Forest Ave., Downers Grove, Ill. 60515

[21] Appl. No.: 2,944

[22] Filed: Jan. 12, 1979

[51] Int. Cl.[3] ..... E04H 17/16

[52] U.S. Cl. ..... 256/24; 256/65

[58] Field of Search ..... 256/24, 21, 65, 68, 256/22, 73

[56] References Cited

U.S. PATENT DOCUMENTS

| | | | |
|---|---|---|---|
| 2,771,276 | 11/1956 | Constance, Jr. et al. | 256/22 |
| 3,101,929 | 8/1963 | Dvore | 256/24 |
| 3,136,530 | 6/1964 | Case | 256/24 |
| 3,234,697 | 2/1966 | Toti et al. | 256/24 UX |
| 3,303,622 | 2/1967 | Minds, Jr. | 256/24 X |
| 4,149,700 | 4/1979 | Stafford | 256/21 X |

*Primary Examiner*—Andrew V. Kundrat

*Attorney, Agent, or Firm*—Neuman, Williams, Anderson & Olson

[57] ABSTRACT

A privacy fence is disclosed in which ease of assembly is emphasized in a system combining predominantly steel elements. The steel rails are nominally four sided, but they are open on one side to permit the insertion of steel fence panels or louvers. A specially designed clip holds each panel in place and resists pilferage which might be expected from casual vandalism. Except for anchoring the rails to the fence posts, no screws, bolts or nail type fasteners are necessary or used. A variety of visual textures is obtained using these elements in a fence section.

15 Claims, 5 Drawing Figures

FIG. 1
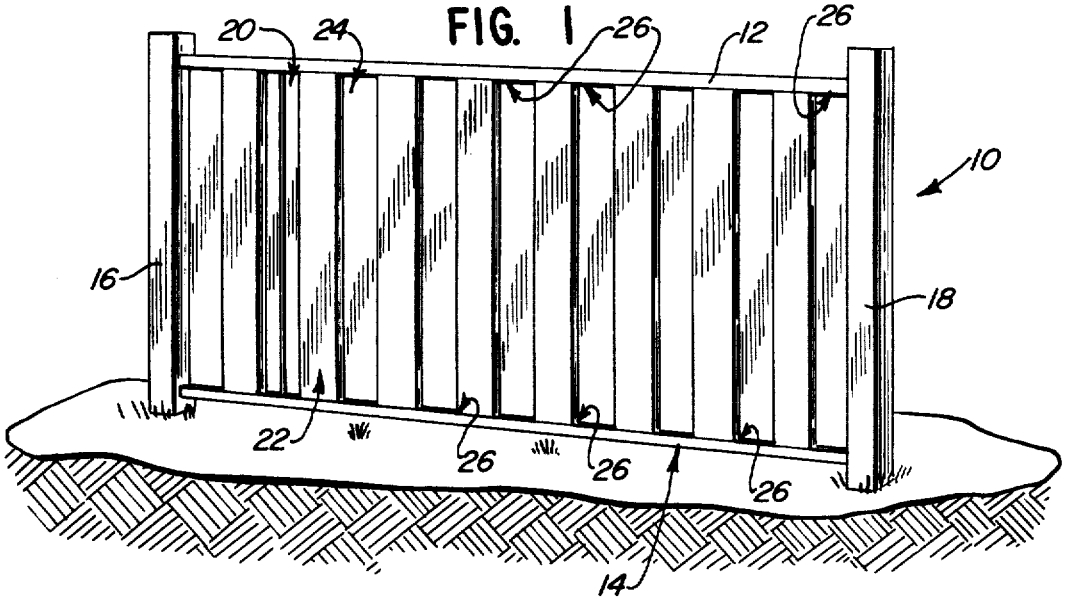
FIG. 2
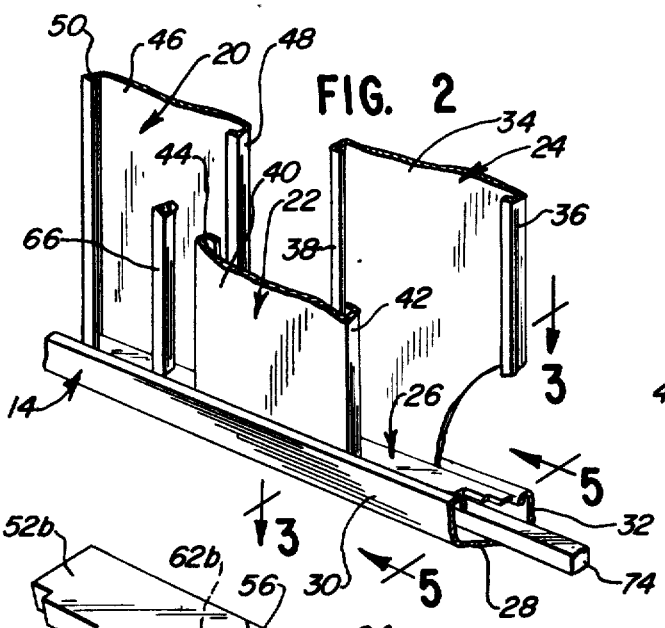
FIG. 3
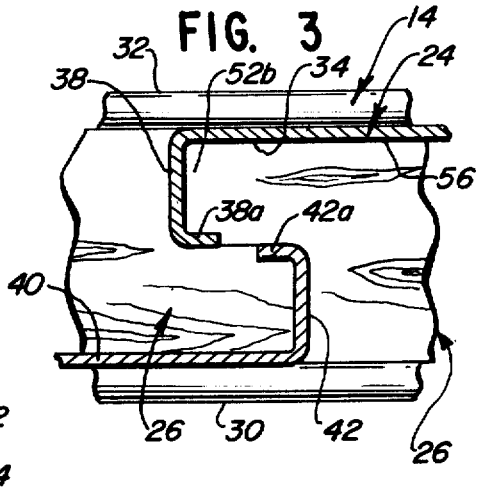
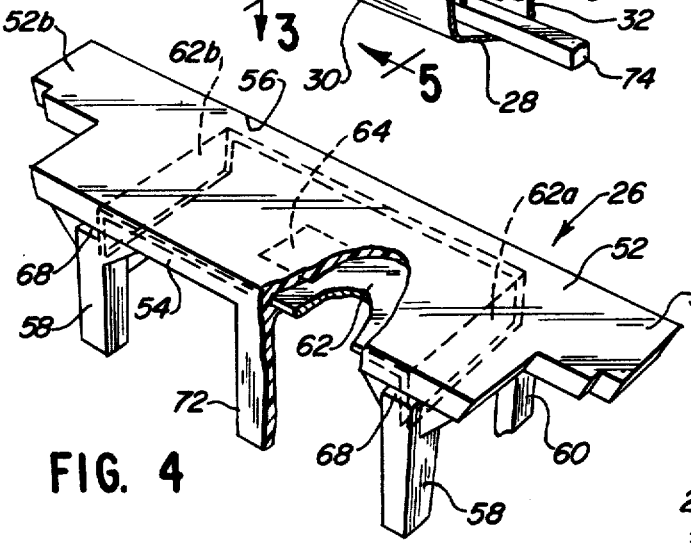
FIG. 4
FIG. 5
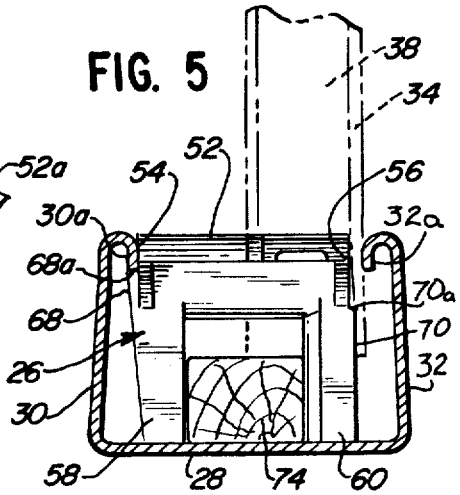

FENCE SYSTEM

This invention relates to a privacy fence construction in which fence rails are suspended between adjacent posts, and decorative fence panels are attached to the rails. More particularly it relates to a system of fence construction which, inter alia, incorporates a novel clip to hold the fence panels in place.

This application discloses a use of the same fence rail as that used in constructions covered by U.S. Pat. Nos. 4,149,700, issued Apr. 17, 1979, and 4,214,734 issued July 29, 1980. The rail is used differently in certain respects in the instant application, as will be evident by comparing it to the earlier patents.

It is an object of this invention to provide a fence system which may be erected without utilizing numerous connections which require the piercing of various parts, such as is necessary when using bolts, screws or nails as fasteners.

It is another object of this invention to provide a fence system which is readily adapted to being erected on sloping terrain while maintaining an alignment of the vertical panels in a perfectly upright attitude.

It is another object of this invention to provide a fence system utilizing clip fasteners which, once the fence is erected, resist being taken out of the fence casually by vandals and also permit ready replacement of the individual fence panels when such panels are damaged.

It is another object of this invention to provide a fence system in which the vertical panels may be spaced apart from each other to permit buffered ventilation and at the same time may be closely overlapped to afford a completely opaque screen.

Still another object of this invention is to provide a system of durable fencing which can be erected with a minimum labor cost and is esthetically pleasing when completed.

These and yet additional objects and features of the invention will become apparent from the following detailed discussion of the exemplary embodiments, and from the drawings and appended claims.

In a preferred form of the present invention a fence section is disclosed comprising at least one rail, a fence panel and a clip. The rail has a cross-sectionally U-shaped configuration including a base panel and a pair of side panels. The fence panel has one of its end portions disposed within the rail intermediate the side panels and is formed of sheet material in a cross-sectionally C-shaped configuration, which configuration includes a face portion and a pair of side portions. The clip maintains the panel end portion within the rail. It engages the panel intermediate the pair of panel side portions and is disposed at least partly within the rail intermediate the fence panel end portion and one of the fence rail side panels. In this construction the clip is wedged between the one side panel of the rail and the face portion of the fence panel, and it urges the face portion into engagement with the other of the rail side panels. A runner, which may be a wooden strip, may be disposed within the rail intermediate the side panels thereof, and the portion of the fence panel rested upon it so that the fence panel is spaced away from the base panel of the rail by the runner.

BRIEF DESCRIPTION OF THE DRAWINGS

For a complete understanding of this invention, reference should be made to the accompanying drawings in which:

FIG. 1 is a perspective view of an assembled fence constructed in accordance with the present invention;

FIG. 2 is a perspective view of a portion of FIG. 1 broken away and enlarged showing part of the bottom rail and portions of the third, fourth and fifth fence panels at the left of the assembled fence shown in FIG. 1;

FIG. 3 is a top plan view of the fence section shown in FIG. 2, enlarged and broken away, in the area of the line 3—3 in FIG. 2;

FIG. 4 is an enlarged perspective view of the panel anchoring clip partly shown in perspective and embodied in the fence portion shown in FIG. 2; and FIG. 5 is an elevational view partly in phantom taken along the section lines 5—5 in FIG. 2.

DETAILED DESCRIPTION OF THE PREFERRED EMBODIMENT

A preferred embodiment of the present invention is shown in larger perspective in the assembled fence illustrated in FIG. 1. Upper and lower rails 12 and 14, respectively, which are identical to each other are suspended horizontally between posts 16 and 18. An open side of the upper rail 12 faces downwardly, and the corresponding open side of the lower rail 14 faces upwardly. Vertical panels, such as 20, 22 and 24, are joined to the rails so that the vertical edges of the panels overlap but do not touch each other. The bottoms and the tops of the panels are fixed in the rails by a plurality of clips 26 which will shortly be described in detail. Even though the fence appears to be solid, it actually is not. The edges of the panels are spaced apart from each other and staggered so that the series of panels presents an opaque surface appearance but actually permits any wind or breeze to pass through it. The force of any wind is therefore buffered by the baffle orientation of the panels.

In the enlarged section of the fence shown in FIG. 2 only the lower end portions of panels 20, 22 and 24 are shown. They are disposed within the rail 14, which is formed cross-sectionally into a U-shape and includes, as shown in this enlarged view, a rail bottom panel 28 and rail side panels 30 and 32. Each fence panel in the preferred embodiment is identically formed, having, as shown with respect to panel 24, a face portion 34 and parallel side portions 36 and 38. See, for example, fence panel 22 having a face portion 40 and parallel side portions 42 and 44. Neighboring fence panel 20 likewise includes a face portion 46 and side portions 48 and 50.

The panels 20, 22 and 24 are preferably lined up in rail 14 so that the edge portions of the panels overlap each other but do not touch, as demonstrated most clearly in FIGS. 2 and 3. Panel side portions 38 and 42 are joined, respectively, to panel face portions 34 and 40 disposed against rail side panels 32 and 30. The said fence panel faces and edge portions extend beyond one another in the rail but terminate close together and leave a narrow air gap between. The gap is most readily observed between the terminus 38*a* of side 38 and the terminus 42*a* of side 42, when the fence panels are made of sheet material formed in a cross-sectionally C-shape and include the slight flange demonstrated by termini 38*a* and 42*a*.

The fence panels are held in place by clip 26. This clip, which also acts as a spacer in the fence structure described herein, includes a planar member 52 having a front edge portion 54 and a rear edge portion 56. The planar member is supported on front legs 58 and rear legs 60. Since in some cases the span of the planar member may be too great for the member to maintain a level surface between and over the legs, a reinforcing plate 62 may be incorporated into the body of the member. In its preferred form the clip 26 may be formed of any suitable plastic material (to withstand temperature fluctuations in hot and cold weather, and to withstand extended exposure to sunlight) which may be easily molded, and the reinforcing plate may be made from a relatively rigid (as compared to the plastic) sheet or ribbon of metal. Two legs **62*a* and 62*b* strengthen the plate still further, although any such rib type support may be incorporated into the plate 62. As shown in FIG. 5, the planar member 52** normally forms a substantially impervious surface between the fence panel and the edge portion of the rail.

In one form the planar member 52 may be made to include a knock-out or otherwise removable insert 64. If desired, a decorative tube or rod 66 (see FIG. 2) may be disposed with one end through the planar member 52, in the aperture left by removal of the insert 64, and the other end disposed through the planar member of clip 26 (not shown) adjacent the top end of fence panel 20 (see FIG. 1). The rod 66, in addition to being decorative (in that it provides decoration itself and also provides a moving shadow pattern on the face portion of the panel), provides a modicum of additional structural strength to a fence which incorporates it. Such a rod may be formed as a solid piece of metal or hollow as a tube or roll form section. Alternatively, removal of the insert 64 provides an aperture in which a small light bulb (not shown) may be mounted instead of the rod 66, thereby permitting a decorative lighting of the fence panel to be made.

Each of the front legs 58 of the clip 26 is formed with a lug 68 on the front surface of the leg and extending outwardly therefrom beyond the limits of the front edge portion 54 of the planar member. As shown in FIG. 5 especially, lug 68 may be created by tapering leg 58 from the foot of the leg in a gradual incline to increase the overall width of the clip adjacent the planar member 52. Such increased width permits a sudden width reduction at the lip **68*a* of the lug and permits a latch or other catch mechanism (as will soon be discussed) to grasp the clip and keep it installed once the fence section, as shown in FIG. 2**, is assembled.

A lug 70, as shown in FIG. 5, similar to lug 68 but having a substantially different purpose, is formed on each rear leg 60 of clip 26. The lug 70 may be created, like lug 68, by tapering leg 60 from the foot of the leg upwardly toward and outwardly from the planar member 52. Like lug 68, lug 70 increases the width of the clip in an upward direction from the foot of leg 60, but unlike lug 68, lug 70 is not intended to engage another mechanism to latch the clip into the fence section. Instead, lug 70 reaches the greatest extent of its outward inclination at a lip **70*a* located at approximately the height of leg 60 and at a point substantially spaced below the planar member 52. The purpose of lug 70 is to broaden the width of the clip 26 specifically at lip 70*a* as shown in FIG. 5 in order to exert localized pressure upon a sheet of material, such as a fence panel, against which the rear edge 56 of the planar member 52** may be positioned.

In practice it has been noted that the accidental exertion of too much thumb pressure on the planar member 52 intermediate the legs 58, or, in other words, generally in the area of the knockout 64 (see FIG. 4), when the clip 26 is installed in a fence section as in FIG. 2, results in a somewhat wavy and irregular orientation of the normally straight front and rear edge portions 54 and 56 of the planar member. Accordingly, an auxiliary leg 72 may be moulded onto planar member 52 adjacent front edge portion 54 and part way between legs 58. As an alternative to moulding, leg 72 may be formed as a peg attached to the planar member. Also, a second, similar auxiliary leg (not shown) may be disposed on the planar member adjacent the rear edge portion 56 intermediate legs 60. Such auxiliary legs are long enough to extend the same distance below the planar member as the legs 58 and 60, thereby preventing any depression of the planar member 52, throughout its length, below the height of the member at legs 58 and 60.

The clip 26 may be used along with a runner 74 (see FIGS. 2 and 4), and the preferred embodiment of the invention shown and described herein incorporates a clip particularly constructed for such use. The runner is straddled by front legs 58 and rear legs 60 but is of substantially lower height than said legs. FIG. 5 showing the clip on the runner illustrates an optimum height of the runner at approximately two-thirds that of legs 58 and 60. In practice it has been found to be desirable to provide a runner having no greater height from the feet of the legs 58 and 60 than about ¼ inch below the height of lip **70*a* on lug 70**.

Assembly of the fence can be made rapidly and simply after posts 16 and 18 have been set in place and rails 12 and 14 are anchored to them. Runner 74 is then laid in the bottom of the lower rail 14. Panels such as 20, 22 and 24 (beginning, normally, at one post or the other in the fence 10) are then inserted in the rails. First the top portion of a fence panel, such as the panel 24, is inserted between the side panels of upper rail 12 clear to the base of the channel formed by the side panels and the base panel of that rail. The fence panel is of such a length that when its upper end portion is fully inserted in the channel of the upper rail, its lower end portion is disposable above the channel of the lower rail 14 formed by side panels 30 and 32 and bottom panel 28. Then, when the lower end portion of the fence panel is lowered into the channel, the end edges of side portions 36 and 38 are brought to rest upon the runner 74. Since the depth of the lower rail 14 created by the runner is shallower than the depth of the upper rail 12 which does not include a runner, panel 24 is retained at both ends within the channels of the two rails.

Clips 26 are then inserted in both rails. The clip in the upper rail does not have a runner to accommodate, but otherwise that clip's disposition is the same as its counterpart in the lower rail. Taking, for example, the disposition of the clip for fence panel 24 in the lower rail, the clip 26 is pressed into place so that its end portions **52*a* and 52*b* are abutted against the side portions 36 and 38, respectively, of panel 24, and rear edge portion 56 is firmly disposed against face portion 34 of the panel. The lower rail 14 is formed from steel and its sides are inclined toward each other as they extend away from the base panel. In the preferred embodiment of this invention, especially as shown in FIG. 5, a lug engaging means such as that shown at 30*a* is formed adjacent the distal edge of rail side panel 30. The bias of the steel side panel 30 permits the panel to be forced away from its counterpart, rail side panel 32, as the clip leg portions 58 and 60 are wedged between the rail side panels. As lug 68 and the lip 68***a* thereof pass the lug engagement means 30*a*, that means snaps over the lug lip and firmly grasps the front of the clip. The front edge 54 of the clip, in the preferred embodiment, limits the inward movement of side panel 30 by engaging the lug engagement means and forming a tight, neat joint with the rail along the entire front edge of the clip.

Rail side panel 32 includes a lug engagement means, such as 32*a*, at its distal edge disposed opposite to and facing the lug engagement means 30*a* on side panel 30. However, with respect to the installation of the clip 26 shown in FIG. 5, the panel face portion 34 is interposed between the lug engagement means 32*a* and rear edge portion 56 of the clip. Normally, a tight, neat joint is formed between the rear edge portion 56 and the face portion 34 along the entire rear edge of the clip. Inside the rail channel, however, lugs 70 which are formed on the rear legs 60 of the clip, somewhat intermediate the point of engagement between the rear edge portion 56 of the clip on the panel face portion 34 and the lowest extremity of the panel face portion, distend the panel face portion inside the rail channel in order to interfere with withdrawal of the face portion past the lug engagement means 32*a* from the rail channel.

As the clip 26 is wedged into place, its front edge portion 54 against the lug engagement means 30*a* and its rear edge portion 56 against the face portion 34 of the fence panel (thus urging the face portion 34 essentially into engagement with side 32 of the rail), excessive pressure in between the clip's front legs 58 may cause a dip in the normally straight line along the front edge portion 54 between the clip's outer end portions 52*a* and 52*b*. From clip to clip along the base of a fence (see FIG. 1), such accidental misalignment is unsightly. As noted above, one or more auxiliary legs 72 are made long enough to extend to the base panel 28 of rail 14 from the correct, horizontally straight-line alignment of front edge 54 and support said edge at the same height as its support by legs 58. Similarly, the rear edge portion 56 of the clip's planar member 52 may be supported in a straight-line alignment by another auxiliary leg (not shown) identical to leg 72.

When it is desirable to modify the shadowbox effect resulting from the construction described above, the decorative rod 66 described above, or a similar upright member, may be installed in between the upper rail 12 and the lower rail 14. The knock-out insert 64 in planar member 52 is supported by a thin membrane around its periphery, and may be removed from the planar member 52 easily. A like knock-out insert in a corresponding clip fixed in the upper rail is removed also. Thus, the rod is inserted in the fence in almost the same manner as a panel, namely, by inserting the upper end into the upper rail channel, moving the lower end over the aperture left by removal of the knock-out insert from the clip fixed in the lower rail, and then lowering the rod through the aperture until its lower end comes to rest on the runner 74.

In the system assembly shown in FIGS. 1–3, a plurality of fence panels are used, alternating their face portions against opposite edges of the rails. The clip may be and preferably is formed, as shown, to hold the panels in alternating, edge-overlapping relationship within the bottom rail (see FIG. 3). Accordingly, in the planar member 52, front edge portion 54 of clip 26 is shorter than the rear edge portion 56, and end portions 52*a* and 52*b* are indented adjacent the front edge portion 54 in order to bring the side portions of two fence panels closer together adjacent front edge portion 54 than the side portions, or edges, of a third fence panel opposite the first two fence panels. Such disposition of the fence panels 20, 22 and 24 is shown in FIG. 2, although the clip is hidden from view; the side portions 38 and 48 of the two fence panels 24 and 20 are closer together adjacent the front edge portion of the clip (formed in the manner of clip 26 in FIG. 4) than the side portions, or edges, 42 and 44 of the third fence panel 22 opposite the first two fence panels and adjacent the rear edge portion 56 of the clip.

The foregoing fence system has been found to be especially successful when the fence panels are made of prepainted long-life finished 24 gauge galvanized sheet steel formed with edge portions which are normal to the face portions, i.e., edge portion 38 and face portion 34, and terminal portions, such as terminus 38*a*, normal to the edge portions. For such fence panel configurations, the end portions of the clips (see end portion 52*a*) are further indented with second indentations to accommodate the fence panel terminal portions. When two clips 26 are disposed in a rail to accommodate such sheet steel fence panels in the alternating manner illustrated in FIG. 2 and described above, the indented clip end portions such as 52*b* overlap each other as in FIG. 3, and the second indentations receive the termini 38*a* and 42*a* of the fence panels with only a slight separation between the termini, normally from about ¼ inch to ½ inch. A breeze or wind can pass through such a separation easily but the proximity of the termini buffer the force of the air current to assure that it is mild on the downwind side. Also, such proximate disposition of the fence panels prohibits any line of sight from one side of the fence to the other, so that complete screening is obtained. Further, this disposition provides substantial thickness, or depth, to the fence and thereby enhances the decorative effect of shadows cast by one panel upon another, while at the same time affording a reflection of light from one side of the fence to the other for a unique visual effect.

Clip end portions 52*a* and 52*b* are also advantageously formed with beveled edges, the acute edge of the bevel being at the top surface of the planar member 52. In installations requiring the rails to be placed over sloping terrain, in which the fence panels are perfectly vertical but have only one side portion resting on the runner 74, the clips are usually disposed with all four feet on the bottom panel of the rail. The beveled edges of the ends of the planar member permit the top surface of the member to be always abutting the side portions of the panels, and unsightly gaps between these elements of the assembly are avoided.

Some installations of the fence 10 may have to be made in areas where abuse of the panels may occur, along a driveway, for example, or in locations subject to damage from delivery or refuse vehicles. When damaged portions of the fence are found in these circumstances, it is not necessary to replace more than the damaged panels themselves. The clips for each panel to be replaced are removed from the rails by forcing the lug engagement means 30*a* out of engagement with the lugs 68, using any convenient prying tool. After gradually working the clips loose, and removing them, the damaged panels can be removed and discarded. New panels are then installed in the manner above described, and the repaired section of the fence will be undetected by normal observation.

While particular embodiments of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A fence section comprising at least one rail having a cross-sectionally U-shaped configuration including a base panel and a pair of side panels, a fence panel having an end portion disposed within the rail intermediate the rail side panels, a clip for maintaining the fence panel end portion within the rail disposed at least partly within the rail intermediate the fence panel end portion and one of the side panels of the rail and urging the panel end portion into engagement with the other of said rail side panels, and a runner disposed within the rail intermediate the side panels thereof, the end portion of the fence panel being spaced apart from the base panel of the rail by the runner.

2. The fence section of claim 1 in which a runner is disposed within the rail intermediate the side panels thereof, and the end portion of the fence panel is spaced apart from the base panel of the rail by the runner.

3. The fence section of claim 1 in which the clip is positioned within the rail on the runner.

4. The fence section of claim 1 in which the clip is positioned within the rail and straddling the runner.

5. A fence section comprising at least one rail having a cross-sectionally U-shaped configuration including a base panel and a pair of side panels, the side panels being arranged substantially parallel to each other and resiliently hinged to the base panel, the distal edges of the side panels being arranged to resiliently oppose each other, a pair of fence panels each having an end portion disposed within the rail intermediate the side panels and the edge portions of the fence panels overlapping each other, a first clip for maintaining the end portion of one of the fence panels within the rail disposed at least partially within the rail intermediate said one fence panel end portion and a first side panel of the rail and urging the said one fence panel end into engagement with the other of said rail side panels, and a second clip for maintaining the end portion of the other fence panel within the rail disposed at least partially within the rail intermediate the end portion of said other of said pair of fence panels and said other side panel of the rail and urging the said end portion of the said other fence panel into engagement with the said first side panel of the rail.

6. The fence section of claim 5 in which the clip is provided with lugs and is engaged thereby on at least one of the side panels of the rail.

7. The fence section of claim 5 in which the clip is provided with lugs and is engaged thereby on the end portion of the fence panel intermediate the rail base panel and the other extremity of the side panel of the rail against which the fence panel end portion is disposed.

8. A fence section comprising at least one rail having a cross-sectionally U-shaped configuration including a base panel and a pair of side panels, a fence panel having an end portion disposed within the rail intermediate the rail side panels, and a clip for maintaining the fence panel end portion within the rail disposed at least partly within the rail intermediate the fence panel end portion and one of the side panels of the rail and urging the panel end portion into engagement with the other of said rail side panels, at least one of the rail side panels being provided with a latching means, and the clip being provided with latch engaging means for engaging said latching means on the rail side panel and thereby maintaining the clip within the rail.

9. A fence section comprising at least one rail having a cross-sectionally U-shaped configuration including a base panel and a pair of side panels, a fence panel having an end portion disposed within the rail intermediate the rail side panels, and a clip for maintaining the fence panel end portion within the rail disposed at least partly within the rail intermediate the fence panel end portion and one of the side panels of the rail and urging the panel end portion into engagement with the other of said rail side panels, at least one of the rail side panels being provided with a lip overhanging the rail base panel, and the clip being provided with lugs and being engaged thereby on the lip of the rail side panel.

10. A fence section comprising at least one rail having a cross-sectionally U-shaped configuration including a base panel and a pair of side panels, a fence panel having an end portion disposed within the rail intermediate the rail side panels, and a clip for maintaining the fence panel end portion within the rail disposed at least partly within the rail intermediate the fence panel end portion and one of the side panels of the rail and urging the panel end portion into engagement with the other of said rail side panels, the clip including a planar member intermediate the side panels of the rail, the said planar member incorporating a knockout panel for exposing an aperture in said member arranged to receive the end portion of a rod spaced apart from and in parallel relation to the fence panel.

11. A clip for fixing the end portion of a fence panel in a cross-sectionally U-shaped fence rail, comprising a planar member having one edge adapted to engage one side of the fence rail and another edge adapted to engage a fence panel disposed against the other side of the fence rail, the planar member being compressed between the one side of the fence rail and the fence panel to urge the panel against the said other side of the fence rail.

12. The clip of claim 11 in which the planar member is connected to legs depending from the planar member and arranged to maintain said member spaced apart from the bottom of the U-shaped fence rail.

13. The clip of claim 11 in which latching means are connected to the planar member for fixing the planar member to the fence rail.

14. The clip of claim 11 in which the planar member incorporates a reinforcing member extending substantially from front edge to rear edge of the planar member between the one side of the fence rail and the fence panel.

15. The clip of claim 11 in which the planar member is connected to legs arranged to maintain said member on a runner disposed in the fence rail for supporting a fence panel.

* * * * *